US011486372B2

(12) United States Patent
Tricard et al.

(10) Patent No.: US 11,486,372 B2
(45) Date of Patent: Nov. 1, 2022

(54) ROTARY BARREL PUMP HAVING SEPARATE GUIDING MEANS AND CENTERING MEANS FOR THE BARREL

(71) Applicant: IFP Energies nouvelles, Rueil-Malmaison (FR)

(72) Inventors: Jean Tricard, Paray Vieille Poste (FR); Julien Trost, Paris (FR); Philippe Pagnier, Saint Clair du Rhone (FR)

(73) Assignee: IFP ENERGIES NOUVELLES, Rueil-Malmaison (FR)

( * ) Notice: Subject to any disclaimer, the term of this patent is extended or adjusted under 35 U.S.C. 154(b) by 297 days.

(21) Appl. No.: 16/757,166

(22) PCT Filed: Oct. 8, 2018

(86) PCT No.: PCT/EP2018/077337

§ 371 (c)(1),
(2) Date: Apr. 17, 2020

(87) PCT Pub. No.: WO2019/076670

PCT Pub. Date: Apr. 25, 2019

(65) Prior Publication Data

US 2021/0123420 A1 Apr. 29, 2021

(30) Foreign Application Priority Data

Oct. 20, 2017 (FR) ..... 1759897

(51) Int. Cl.
*F04B 1/2035* (2020.01)
*F04B 1/128* (2020.01)
(Continued)

(52) U.S. Cl.
CPC ..... *F04B 1/2035* (2013.01); *E21B 43/12* (2013.01); *F04B 1/128* (2013.01); *F04B 1/2064* (2013.01); *F04B 1/2071* (2013.01); *F04B 1/2078* (2013.01); *F04B 49/123* (2013.01); *F04B 53/14* (2013.01); *F04B 53/16* (2013.01)

(58) Field of Classification Search
None
See application file for complete search history.

(56) References Cited

U.S. PATENT DOCUMENTS 1,945,391 A 1/1934 Benedek
2,972,955 A 2/1961 Richter et al.
(Continued)

FOREIGN PATENT DOCUMENTS

FR 1488511 A 7/1967
GB 532635 A 1/1941
GB 588451 A 5/1947

OTHER PUBLICATIONS

International Search Report for PCT/EP2018/077337, dated Oct. 26, 2018; English translation submitted herewith (7 pgs.).
(Continued)

*Primary Examiner* — Essama Omgba
*Assistant Examiner* — Geoffrey S Lee
(74) *Attorney, Agent, or Firm* — Fitch, Even, Tabin & Flannery LLP

(57) ABSTRACT

The present invention relates to a rotary barrel pump where the pivot connection between barrel (6) and casing (15) is provided by the distinct guide and centering means.

9 Claims, 2 Drawing Sheets

(51) Int. Cl.

| | |
|---|---|
| ***F04B 1/2064*** | (2020.01) |
| ***F04B 1/2071*** | (2020.01) |
| ***F04B 1/2078*** | (2020.01) |
| ***F04B 49/12*** | (2006.01) |
| ***F04B 53/14*** | (2006.01) |
| ***F04B 53/16*** | (2006.01) |
| ***E21B 43/12*** | (2006.01) |

(56) References Cited

U.S. PATENT DOCUMENTS

| | | | | | |
|---|---|---|---|---|---|
| 4,281,971 | A | * | 8/1981 | Kouns | F04B 23/14<br>417/205 |
| 4,615,257 | A | * | 10/1986 | Valentin | F04B 1/2071<br>91/487 |
| RE32,373 | E | * | 3/1987 | Bobier | F04B 1/20<br>91/506 |
| RE32,403 | E | * | 4/1987 | Bobier | F04B 1/324<br>91/506 |
| 5,538,401 | A | * | 7/1996 | Schaffner | F04B 1/2078<br>417/269 |
| 2002/0069752 | A1 | | 6/2002 | Forster | |

OTHER PUBLICATIONS

Chinese Office for Application 201880066888.5, dated Jul. 28, 2021, along with an English translation.

* cited by examiner

ROTARY BARREL PUMP HAVING SEPARATE GUIDING MEANS AND CENTERING MEANS FOR THE BARREL

CROSS-REFERENCE TO RELATED APPLICATIONS

Reference is made to International Application No. PCT/EP2018/077337, filed Oct. 8, 2018, which claims priority to French Patent application Ser. No. 17/59,897, filed Oct. 20, 2017, the contents of which are incorporated herein by reference in their entirety.

BACKGROUND OF THE INVENTION

Field of the Invention

The present invention relates to pumps and in particular for high-pressure pumps, notably for drilling operations.

Today, crankshaft drive pumps are the most widely used across all industry sectors including capital goods, oil, gas and food industries, automotive industry, building industry (heating, wells, air conditioning, water pumps, etc.), and more specifically for water and waste treatment (water network and wastewater system). However, they are still manufactured on the basis of designs dating from the 1930s, and very few research and development surveys have been carried out to improve their performances, reduce their cost price, minimize their maintenance costs or decrease their environmental footprint. These pumps have limits in terms of power, pressure/flow rate torque that results in pressure surge type phenomena generated by the sinusoidal response of the pressure produced by the crankshaft, weight, efficiency and service life. Furthermore, they do not allow a variable displacement and they therefore lack flexibility in use.

Moreover, in the field of hydrocarbon production, it is currently observed that wellbores need to reach increasingly great depths, which involves working at increasingly high injection pressures. Oil companies therefore need ultra-high pressure pumps to reach the required depths for drilling mud injection for example. These pumps must also be reliable, economical, flexible and compact, so as to meet the ever more demanding requirements of the energy sector.

Another positive-displacement pump technology is the barrel pump. It is mainly intended for pumping at lower pressure and flow rate (it is mainly used for pumping hydraulic oils) and it has many advantages:

excellent weight/power ratio very good price/performance ratio interesting mechanical and volumetric efficiencies variable displacement capacity through plate inclination adjustment.

Pumps designed with a barrel operate by using a rotary plate system that actuates the various pistons one after another. When a piston is in an intake phase, the opposite piston is in delivery mode, which provides a constant flow upstream and downstream from the pump. The distribution of the piston positions guided by the barrel provides a progressive distribution of the forces upon rotation of the shaft driven by the motor.

There are three main barrel pump architectures:

stationary barrel pumps (FIG. 1): In this configuration of pump 1, where the barrel is stationary, an inclined plate 2 rotates (driven by shaft 5) which generates the motion of pistons 3 in their sleeves 4 (compression chamber). The link between pistons 3 and plate 2 is then provided by ball joint pads that rub on plate 2. The advantage here is a very low inertia of the rotating parts. However, this configuration makes it difficult to have a variable displacement. Furthermore, in the case of high pressures and flow rates, the friction forces between the plate and the pads are not negligible and make it difficult, or even impossible, to produce the pump;

swash-plate barrel pumps: The barrel is stationary in this architecture. There are two plates with a first inclined plate rotating and transmitting to the second plate only the oscillating motion. Thus, the pistons can be linked to the second plate, the swash plate, without friction members being required, for example with a connecting rod linked to the piston and to the plate by ball joint links. This architecture is suited to high-pressure pumping due to the absence of friction elements (moreover, some can be found in the geothermal energy market). It provides an excellent mechanical efficiency. This configuration makes it possible to produce a variable displacement, which however remains difficult to integrate and to design;

rotary barrel pumps (FIG. 2): Within pump 1, plate 2 is stationary and barrel 6 carrying pistons 3 rotates, which provides motion of pistons 3 in their sleeves 4 (compression chamber). The link between piston 3 and plate 2 is provided in the same manner as for the first configuration. The advantage of this architecture is that the plate can be readily adjusted in inclination, which makes it possible to have a variable displacement. On the other hand, the inertia of the rotating parts increases in a quite significant manner since the barrel and all of the pistons are rotated. Furthermore, for this configuration, pump maintenance is difficult which requires the entire barrel to be removed, including the "mechanical" piston guide part to allow access to the inlet and outlet pipes. Generally, for this configuration, the barrel is produced in two parts, which makes it difficult to mount, because it requires good colinearity of the guide pins and of the chamber.

SUMMARY OF THE INVENTION

In order to overcome these drawbacks, the present invention relates to a rotary barrel pump where the pivot connection between the barrel and the casing is provided by the distinct guide and centering means. This design allows differentiation of the guiding and sealing functions, which facilitates maintenance and servicing of the pump.

The invention relates to a barrel pump comprising a casing and comprising, within the casing:

a drive shaft, a cylinder block comprising at least two circumferentially distributed compression chambers, with the cylinder block being driven by the drive shaft, a plate with an adjustable inclination, at least two pistons in translation respectively in the compression chambers of the cylinder block, with the pistons being driven by the plate by connecting rods.

The cylinder block is in pivotable connection relative to the casing through separate guide means and centering apparatus.

According to an embodiment of the invention, the cylinder block is one-piece, comprising a first part for guiding the pistons and a second part comprising the compression chambers.

Advantageously, the inner spaces of the first and second parts of the cylinder block do not communicate with one another.

Preferably, the first and second parts of the cylinder block are connected by a third part whose diameter is smaller than the diameters of the first and second parts of the block cylinder.

According to an aspect of the invention, the guide means comprises two angular-contact roller bearings in a face-to-face arrangement on the first part of the cylinder block.

According to a feature, the centering apparatus comprise ball bearing mounted on the second part of the cylinder block.

According to an implementation of the invention, the cylinder block is driven by the drive shaft by splines provided on the drive shaft.

Advantageously, the splines are provided at the end of the drive shaft.

According to an embodiment, the pistons are in a sliding and pivoting connection in the cylinder block.

According to an aspect of the invention, the cylinder block comprises sealing of the inlet and outlet pipes of the pump.

According to an implementation, the barrel pump comprises a control of the inclination of the plate.

Preferably, the inclination control comprises a worm drive system.

Furthermore, the invention relates to a use of the barrel pump according to one of the above features for a drilling operation, in particular for injecting drilling mud into a wellbore.

BRIEF DESCRIPTION OF THE DRAWINGS

Other features and advantages of the device according to the invention will be clear from reading the description hereafter of embodiments given by way of non-limitative example, with reference to the accompanying drawings wherein.

DETAILED DESCRIPTION OF THE INVENTION

Figure 1:
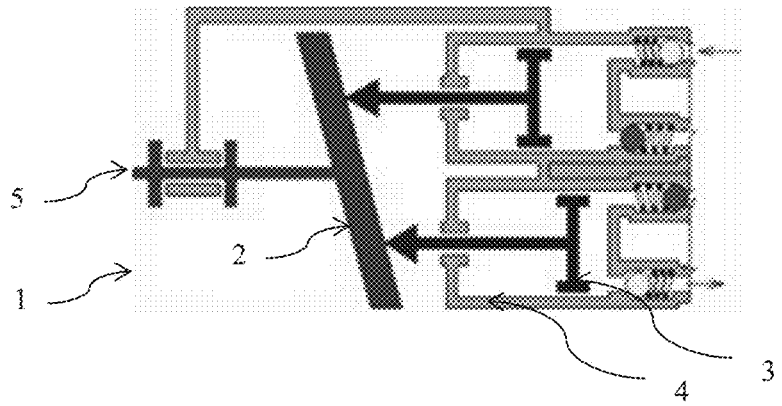
Figure 1 (PRIOR ART)
FIG. 1, already described, illustrates a stationary barrel pump according to the prior art.
Figure 2:
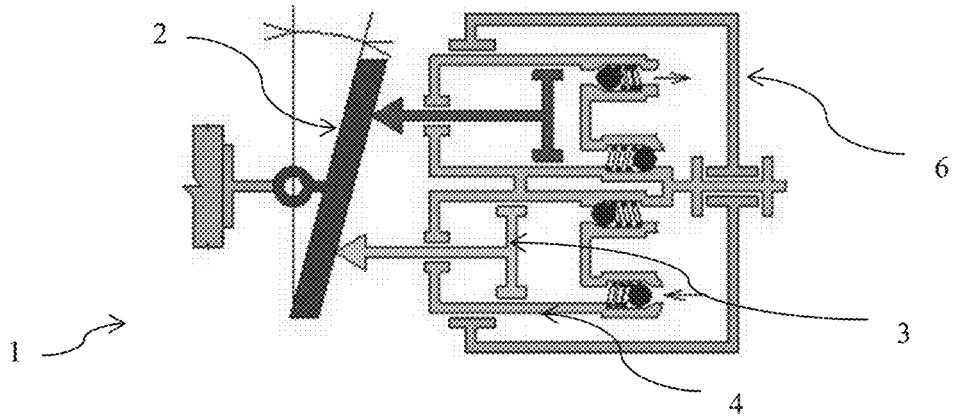
Figure 2 (PRIOR ART)
FIG. 2, already described, illustrates a rotary barrel pump according to the prior art.

The present invention relates to a rotary barrel pump. The purpose of the barrel pump is to pump a fluid (for example water, oil, gas, drilling mud, etc.) through a linear displacement of several pistons. This type of pump affords the advantage of being compact, providing interesting mechanical and volumetric efficiencies, as well as an excellent weight/power ratio. Furthermore, rotary barrel pumps are suited for high-pressure pumping.

The barrel pump according to the invention comprises a casing in which is located:

a drive shaft driven in rotation relative to the casing by an external energy source, notably a prime mover (thermal or electric for example), in particular by a transmission (a gearbox for example);

an adjustable plate inclined relative to the drive shaft;

a cylinder block (referred to as barrel) comprising at least two circumferentially distributed (in other words, arranged in a circle) compression chambers (also referred to as sleeves) with the cylinder block being rotatable relative to the casing and driven by the drive shaft; and at least two pistons which translate respectively in the compression chambers, the pistons are driven by the cylinder block, and connecting rods connect, by the use of ball joint links, the mobile plate and the pistons so as to convert the rotary motion of the cylinder block into a translational motion of the pistons, which generates pumping of the fluid.

Adjusting the plate inclination varies the displacement of the pump, by modifying the stroke of the pistons.

According to the invention, the pivoting connection between the cylinder block and the casing includes separate guides and centering devices.

According to an embodiment of the invention, the cylinder block can be one-piece (i.e. made of a single piece). The advantage of "merging" the two parts of the cylinder block (that can be found in the prior art) is to provide good colinearity of the guide pins and of the chamber, thus allowing machining of the assembly the guide and seals at once. Furthermore, this design involves a limited mass since the assembly functions without optional parts of the cylinder block without no more screws, washers, nuts, etc. Moreover, the one-piece design simplifies mounting of the pump barrel and maintenance of the pump during service. Indeed, for maintenance, due to the separation of the guides and the centering apparatus, it is possible to remove only the centering apparatus or only the guides.

According to an implementation of the invention, the cylinder block can comprise a first part for guiding the pistons and a second part which provides sealing, the second part including the compression chambers of the cylinder block. Thus, the second part provides for intake and discharge of the pumped fluid. Once the pump is assembled, the inner spaces of the two parts of the cylinder block do not communicate. In other words, once the pump assembled, a fluid contained in the first part cannot be found in the second part, and vice versa. This design allows separation of the mechanical side of the pump (first part with the moving parts) from the hydraulic side thereof (second part with the intake and the bearing). Maintenance of the pump is thus facilitated. According to an example embodiment, separation of the inner spaces can be achieved by use of an inner lid.

Preferably, in order to achieve the pivotable connection between the cylinder block and the casing, the first and second parts can have a substantially cylindrical shape.

According to an aspect of this implementation of the invention, the first and second parts can be linked by a third part. Advantageously, this third part can be substantially cylindrical and it can have a smaller diameter than the first and second parts.

According to an aspect of this embodiment, the guide and centering apparatus can comprise two angular-contact roller bearings in a face-to-face arrangement (the centers of pressure of the bearings are located between the two bearings). This configuration enables guidance and it is suited for high rotational speeds with significant loads. According to an example embodiment, the two angular-contact roller bearings can be mounted on the first part of the cylinder block.

Furthermore, a ball bearing can be provided which limits a cantilever of the part and provides centering thereof over the total length. A ball bearing has the advantage of being suited to high rotational speeds. The loads on this bearing are limited which provides compactness and lightness. According to an example embodiment, the ball bearing can be mounted on the second part of the cylinder block.

According to an embodiment of the invention, the cylinder block can be driven by the drive shaft by use of splines provided on the drive shaft. In other words, the drive shaft can comprise male splines and the barrel can comprise female splines cooperating with the male splines of the drive shaft. The splines allow transmission of a high torque. According to an example embodiment, the female splines can be arranged in the second part of the cylinder block and optionally in the third part of the cylinder block. Alternatively, the female splines can be provided on the first part of the cylinder block.

In a variant embodiment, the cylinder block can be driven by use of a key provided in the drive shaft.

Advantageously, the pistons can be in a sliding and pivoting connection in the barrel, in particular in the first part of the cylinder block, notably by use of a ring. Thus, the pistons are guided for the reciprocating motion thereof.

The plate can have substantially the shape of a disc. However, the plate may have any shape. Only the compression chambers (and the pistons) are arranged in a circle.

Advantageously, the pump according to the invention can comprise a number of pistons ranging between three and fifteen, preferably between five and eleven. Thus, a large number of pistons provides a continuous flow upstream and downstream from the pump.

Conventionally, the pump further comprises an inlet (intake) and an outlet (discharge) for the fluid to be pumped. The fluid passes through the pump inlet, flows into a compression chamber, where it is compressed, then it is discharged from the pump through the outlet by means of the piston.

In addition, the barrel, in particular the second part of the cylinder block, can comprise seals between the inlet and outlet pipes of the pump.

According to an embodiment of the invention, the angle of inclination of the plate is variable relative to the axial direction of the drive shaft so as to range between 70° and 90°. In other words, the variable-inclination plate (and a fortiori the rotary plate) is inclined at an angle ranging between 0° and 20° to a radial direction of the drive shaft.

According to an implementation of the invention, the barrel pump can comprise a control of the inclination of the variable-inclination plate. For example, this control can comprise a worm drive system.

According to an embodiment of the invention, the pump can comprise a second plate (rotary plate). The second plate can be in pivot connection with the variable-inclination plate and it can be driven by the drive shaft. The second plate can be driven by a finger swivel connection. This pump design provides a plate that rotates synchronously with the cylinder block, which allows to use of ball joint links (between connecting rods and plate) without friction pads, which provides higher barrel pump efficiency.

Figure 3:
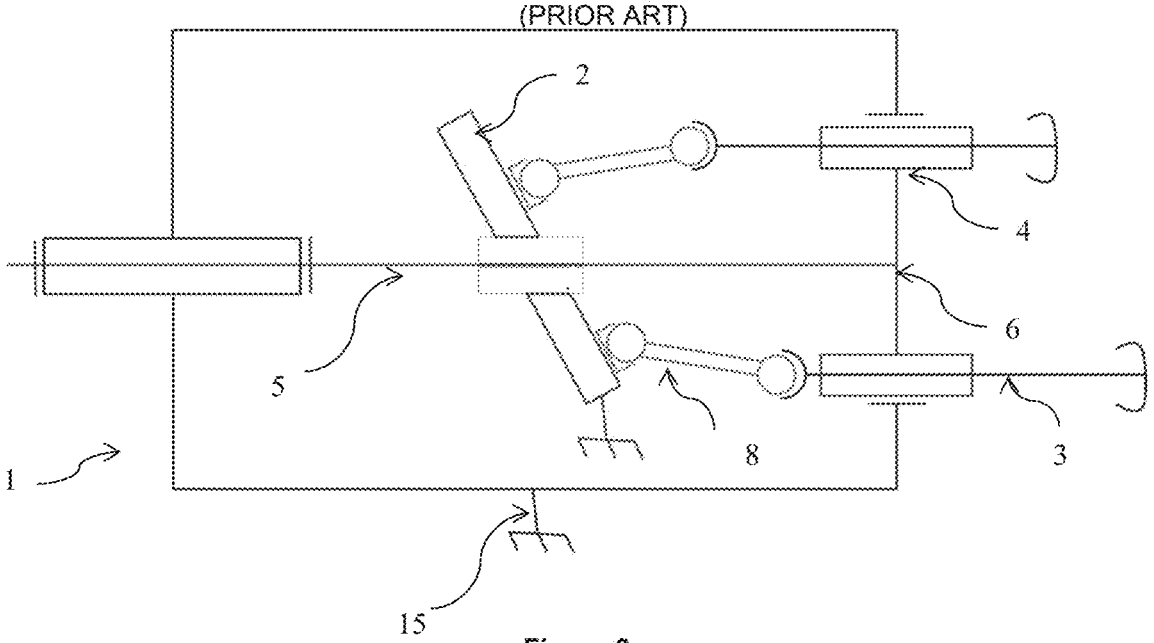
FIG. 3 illustrates a barrel pump according to an embodiment of the invention.

FIG. 3 schematically illustrates, by way of non-limitative example, a kinematic diagram of a rotary barrel pump according to an embodiment of the invention. Rotary barrel pump 1 comprises a drive shaft 5. The rotation of drive shaft 5 is performed by an external source, not shown, such as an electric machine and a gearbox. Drive shaft 5 rotates with respect to casing 15. Furthermore, drive shaft 5 rotationally drives cylinder block 6 that comprises compression chambers 4. Pump 1 further comprises a variable-inclination of plate 2 which, except for the adjustable inclination thereof, is stationary with respect to casing 15. The mechanism for adjusting the inclination of variable-inclination plate 2 is not shown.

Pump 1 comprises a piston 3 driven by a translational motion (reciprocating motion) within a compression chamber 4.

The reciprocating motion of piston 3 is achieved by a rod 8 connecting mobile plate 2 and piston 3 by use of ball joint links. This reciprocating motion of piston 3 within compression chamber 4 allows the fluid to be pumped.

Figure 4:
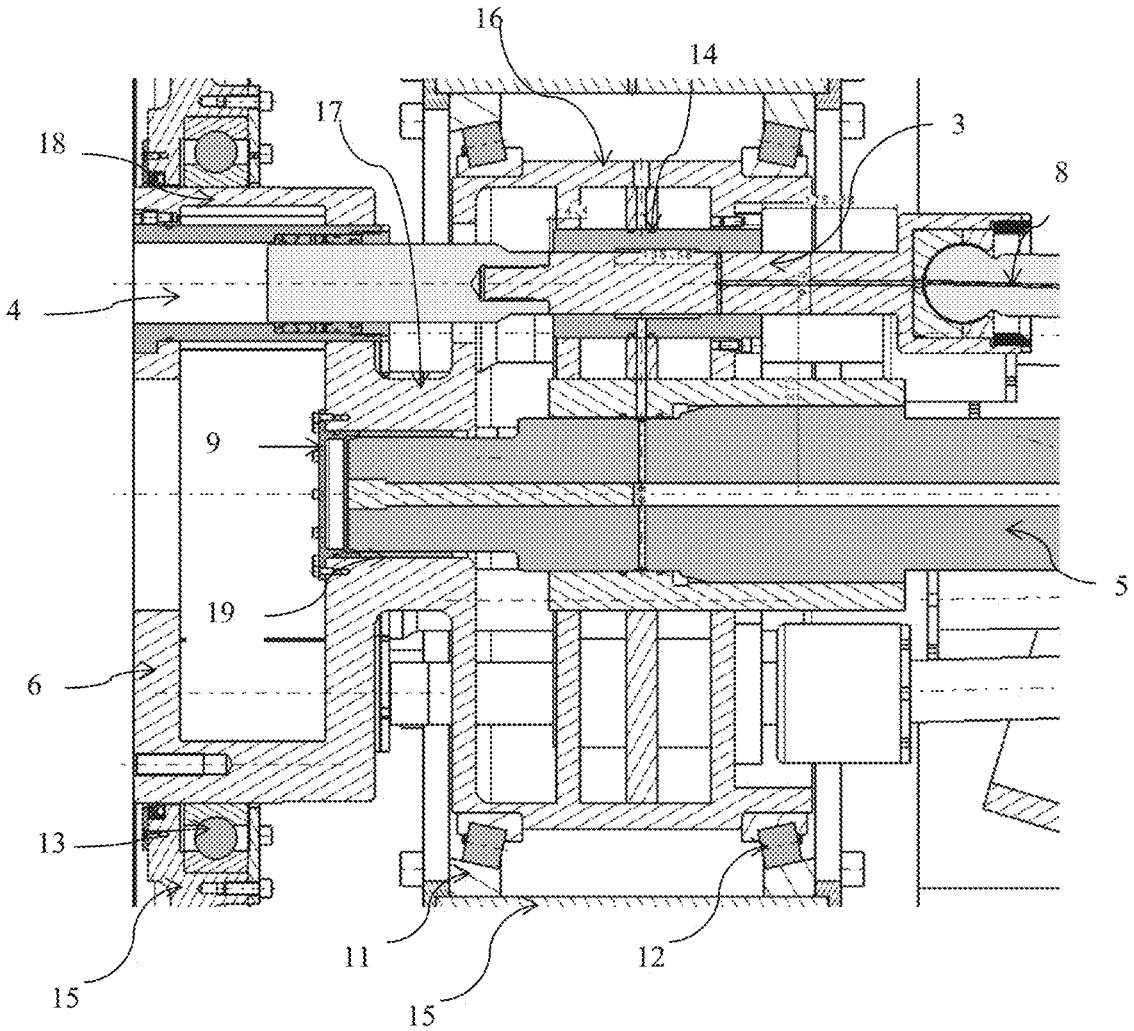
FIG. 4 illustrates the relative assembly of the two barrels according to an embodiment of the invention.

FIG. 4 schematically illustrates, by way of non-limitative example, a sectional view of the barrel according to an embodiment of the invention. It is a sectional view on a plane comprising the axis of drive shaft 5. Cylinder block 6 comprises a first part 16 which guides pistons 3 and a second part 18 including compression chambers 4. Furthermore, cylinder block 6 comprises a third part 17 connecting first part 16 to second part 18. The first and second parts 16 and 18 have a substantially cylindrical shape. Third part 17 is also cylindrical and has a smaller diameter than first and second parts 16 and 18.

A lid 9 is provided at the end of drive shaft 5 so as to separate the inner spaces of first and second parts 16 and 18.

Cylinder block 6 is rotationally mounted in casing 15 by a centering device and guide device.

The centering device comprises a ball bearing 13 mounted between second part 18 of barrel 6 and casing 15.

The guide comprise two angular-contact roller bearings 11 and 12 mounted between first part 16 of barrel 6 and casing 15. Angular-contact roller bearings 11 and 12 are arranged face-to-face.

For guidance of each piston 3, first part 16 of barrel 6 comprises a ring 14 providing a sliding pivot connection between piston 3 and barrel 6.

For driving the cylinder block, drive shaft 5 comprises at its end splines 19 cooperating with female splines (not shown) provided in the second and third parts 18 and 17 of cylinder block 6.

The invention also relates to the use of the pump according to the invention for a drilling operation, in particular for injecting drilling mud into a wellbore. Indeed, the pump according to the invention is well suited for this use due to its flexibility, compactness and high pressure strength.

For example, the pump according to the invention can be sized to operate up to pressures of the order of 1500 bar, that is 150 MPa. Moreover, the pump according to the invention can be sized to operate at flow rates ranging from 30 to 600 $m^3/h$.

The invention claimed is:

1. A barrel pump comprising a casing and, the casing including: a drive shaft; a cylinder block comprising at least two circumferentially distributed compression chambers and the cylinder block being driven by the drive shaft; a plate including variable inclination; at least two pistons which reciprocate respectively in the distributed compression chambers of the cylinder block with the pistons being driven by the plate by connecting rods; and the cylinder block including a connection pivotable relative to the casing including separate guides and a centering means for centering rotary movement of the block in the casing, and wherein; the cylinder block is one-piece comprising a first part for guiding the pistons and a second part comprising the compression chambers and the centering means comprises a ball bearing mounted on the second part of the cylinder block, the cylinder block provides intake and discharge of pumped fluid and the first and second parts of the cylinder block have inner spaces which do not communicate.

2. A pump as claimed in claim 1, wherein the first and the second parts of the cylinder block are connected by a third part having a diameter smaller than diameters of the first and second part of the cylinder block.

3. A pump as claimed in claim 2, comprising a front part including angular-contact roller bearings oriented face-to-face on the first part of the cylinder block which guides the at least two pistons.

4. A pump as claimed in claim 1, comprising a front part including angular-contact roller bearings oriented face-to-face on the first part of the cylinder block which guides the at least two pistons.

5. A pump as claimed in claim 1, wherein the cylinder block is driven by the drive shaft with splines provided on the drive shaft.

6. A pump as claimed in claim 5, wherein the splines are provided at an end of the drive shaft.

7. A pump as claimed in claim 1, wherein the pistons are in a sliding and pivotable connection with the cylinder block.

8. A pump as claimed in claim 1, wherein the cylinder block comprises seals at the inlet and outlet pipes of the pump.

9. A pump as claimed in claim 1, wherein the barrel pump comprises a control for varying inclination of the plate.

* * * * *